US010132078B2

(12) United States Patent
Parr et al.

(10) Patent No.: US 10,132,078 B2
(45) Date of Patent: Nov. 20, 2018

(54) SCREEN ASSEMBLY

(71) Applicant: Herman Miller, Inc., Zeeland, MI (US)

(72) Inventors: Joe Parr, Grand Rapids, MI (US); Paul Gartland, Holland, MI (US); Larry Kallio, Grand Haven, MI (US)

(73) Assignee: Herman Miller, Inc., Zeeland, MI (US)

( * ) Notice: Subject to any disclaimer, the term of this patent is extended or adjusted under 35 U.S.C. 154(b) by 0 days.

(21) Appl. No.: 15/233,439

(22) Filed: Aug. 10, 2016

(65) Prior Publication Data

US 2017/0044765 A1 Feb. 16, 2017

Related U.S. Application Data

(60) Provisional application No. 62/203,209, filed on Aug. 10, 2015.

(51) Int. Cl.

| | |
|---|---|
| ***E04B 1/61*** | (2006.01) |
| ***E04B 2/74*** | (2006.01) |
| ***E06B 9/24*** | (2006.01) |

(52) U.S. Cl.

CPC ..... *E04B 2/7425* (2013.01); *E06B 9/24* (2013.01); *E04B 2/7427* (2013.01); *E04B 2002/749* (2013.01); *E04B 2002/7479* (2013.01); *E04B 2002/7483* (2013.01)

(58) Field of Classification Search

CPC ..... E04B 2/7425; E04B 2/7405; E04B 2002/749; E04B 1/6116

USPC ..... 52/582.2, 127.11, 127.7; 403/322.4, 325, 403/322.1, 49, 294, 292, 297, 20, 408.1, 403/329, 357

See application file for complete search history.

(56) References Cited

U.S. PATENT DOCUMENTS

| | | | | | |
|---|---|---|---|---|---|
| 2,581,816 | A * | 1/1952 | Schlueter | E04B 1/6183 | 292/204 |
| 3,567,260 | A * | 3/1971 | Norris | E04B 1/6162 | 52/127.11 |
| 4,045,927 | A * | 9/1977 | Diaz | E04B 1/6162 | 403/292 |
| 4,338,754 | A * | 7/1982 | Woods | E04B 2/7425 | 52/393 |
| 4,466,377 | A * | 8/1984 | Kolb | B25G 3/18 | 16/422 |
| 4,821,788 | A * | 4/1989 | Nelson | E04B 2/7425 | 160/135 |
| 5,347,778 | A * | 9/1994 | Bray | E04B 2/7425 | 160/135 |

(Continued)

*Primary Examiner* — Katherine W Mitchell
*Assistant Examiner* — Abe Massad
(74) *Attorney, Agent, or Firm* — Michael Best & Friedrich LLP

(57) ABSTRACT

A screen assembly includes a first screen, a second screen, and a connector. Each screen includes a panel with a recess and a receiver positioned within the recess. The receiver has a locking member and an actuator. The actuator is operable to move the locking member relative to the receiver. The connector includes a body, a first contact extending from the body in a first direction, and a second contact extending from the body in a second direction. The first contact is received in the receiver of the first screen and has a first opening through which the first locking member extends. The second contact is received in the receiver of the second screen and has a second opening through which the second locking member extends.

12 Claims, 15 Drawing Sheets

(56) References Cited

U.S. PATENT DOCUMENTS

| | | | | |
|---|---|---|---|---|
| 5,480,117 | A * | 1/1996 | Fleming, III | E04B 1/6183 248/231.9 |
| 8,434,963 | B2 * | 5/2013 | Alkas | E04B 1/5831 24/663 |
| 2014/0311036 | A1 | 10/2014 | Alexander et al. | |
| 2017/0044765 | A1 * | 2/2017 | Parr | E04B 2/7425 |

* cited by examiner

SCREEN ASSEMBLY

CROSS-REFERENCE TO RELATED APPLICATIONS

This application claims priority to U.S. Provisional Patent Application No. 62/203,209, filed Aug. 10, 2015, the entire contents of which are incorporated by reference herein.

BACKGROUND

The present disclosure relates to screen assemblies and, more particularly, to screen assemblies usable in offices, schools, hospitals, and other types of buildings to separate workspaces.

SUMMARY

In one embodiment, the invention provides a screen assembly including a first screen having a first panel with a first recess and a first receiver positioned within the first recess. The first receiver has a first locking member and a first actuator. The first actuator is operable to move the first locking member relative to the first receiver. The screen assembly also includes a second screen having a second panel with a second recess and a second receiver positioned within the second recess. The second receiver has a second locking member and a second actuator. The second actuator is operable to move the second locking member relative to the second receiver. The screen assembly further includes a connector having a body, a first contact extending from the body in a first direction, and a second contact extending from the body in a second direction. The first contact is received in the first receiver and has a first opening through which the first locking member extends. The second contact is received in the second receiver and has a second opening through which the second locking member extends.

In another embodiment, the invention provides a screen assembly including a screen having a panel and a receiver. The panel has a first recess and a second recess spaced from the first recess. The receiver is positioned within the first recess. The receiver has a locking member and an actuator. The actuator is operable to move the locking member relative to the receiver. The screen assembly also includes a connector having a body, a first contact extending from the body in a first direction, and a second contact extending from the body in a second direction. The first contact is received in the receiver and has a first opening through which the locking member extends. The screen assembly further includes a stand assembly having a mount and a stand. The mount is received in the second recess and has an aperture. The stand has a stem and a foot. The stem is received in the aperture. The foot is coupled to an end of the stem opposite the mount.

In yet another embodiment, the invention provides a screen assembly including a first screen having a first panel and a first receiver. The first panel has a first recess positioned along a first edge of the first panel and a second recess positioned along a second edge of the first panel that is perpendicular to the first edge. The first receiver is positioned within the first recess and has a first locking member and a first actuator. The first actuator is operable to move the first locking member relative to the first receiver. The screen assembly also includes a second screen having a second panel and a second receiver. The second panel has a third recess positioned along a third edge of the second panel and a fourth recess positioned along a fourth edge of the second panel that is perpendicular to the third edge. The second receiver is positioned within the third recess and has a second locking member and a second actuator. The second actuator is operable to move the second locking member relative to the second receiver. The screen assembly further includes a connector having a body, a first contact extending from the body in a first direction, and a second contact extending from the body in a second direction. The first contact is received in the first receiver and has a first opening through which the first locking member extends. The second contact is received in the second receiver and has a second opening through which the second locking member extends. The screen assembly also includes a first stand assembly having a first mount and a first stand. The first mount is received in the second recess of the first panel and has a first aperture. The first stand has a first stem and a first foot. The first stem is received in the first aperture. The first foot is coupled to an end of the first stem opposite the first mount. The screen assembly further includes a second stand assembly having a second mount and a second stand. The second mount is received in the fourth recess of the second panel and has a second aperture. The second stand has a second stem and a second foot. The second stem is received in the second aperture. The second foot is coupled to an end of the second stem opposite the second mount.

Other aspects of the invention will become apparent by consideration of the detailed description and accompanying drawings.

DETAILED DESCRIPTION

Before any embodiments of the disclosure are explained in detail, it is to be understood that the disclosure is not limited in its application to the details of construction and the arrangement of components set forth in the following description or illustrated in the following drawings. The disclosure is capable of other embodiments and of being practiced or of being carried out in various ways.

Figure 1:
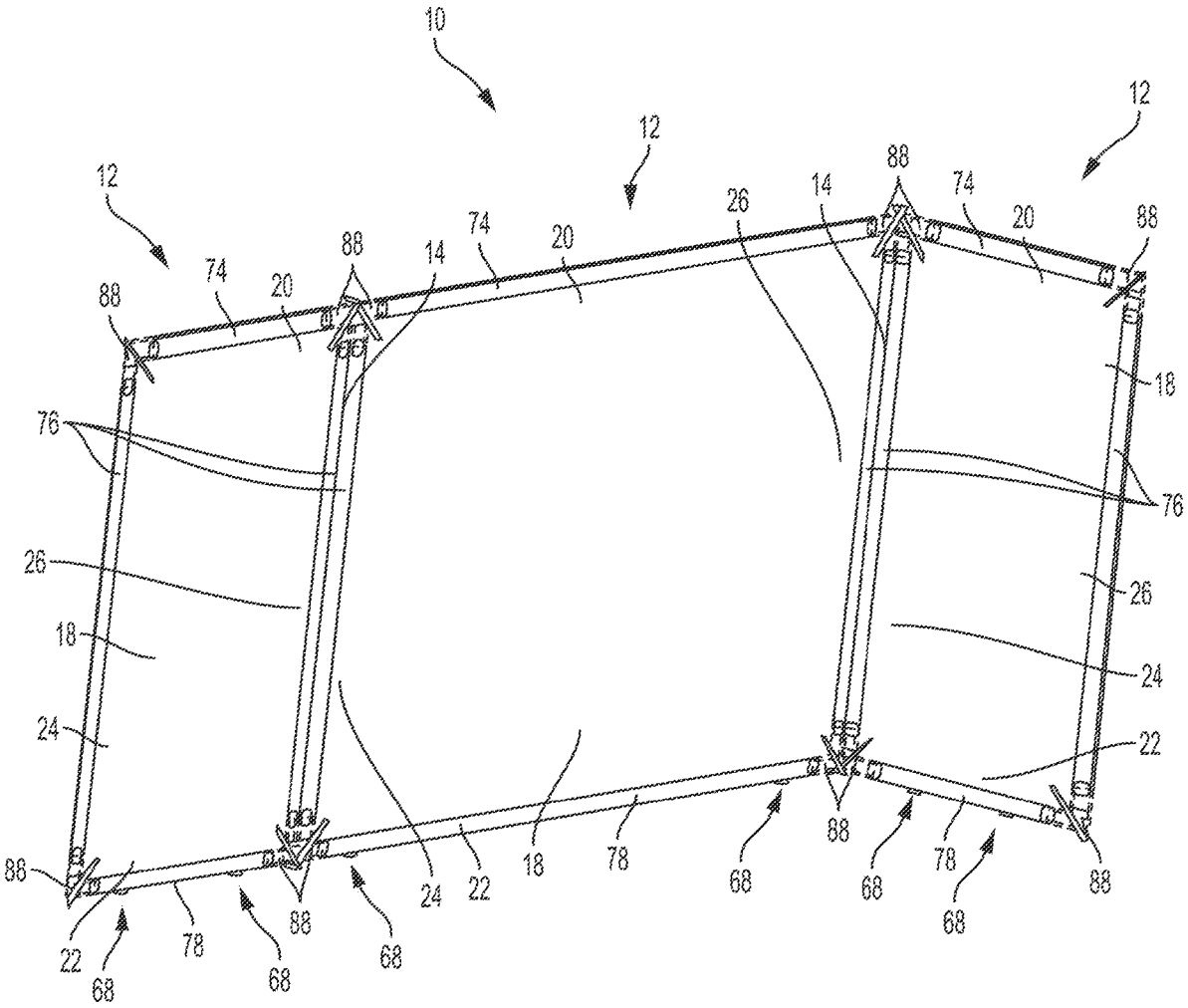
FIG. 1 is a perspective view of a screen assembly, the screen assembly including three screens coupled together by connectors.

FIG. 1 illustrates a screen assembly 10. The illustrated screen assembly 10 is a floor standing screen assembly that divides or separates workspaces. The screen assembly 10 includes a plurality of screens 12 that are coupled together by connectors 14. One connector 14 is positioned between two adjacent screens 12 to releasably secure the screens 12 together.

Figure 2:
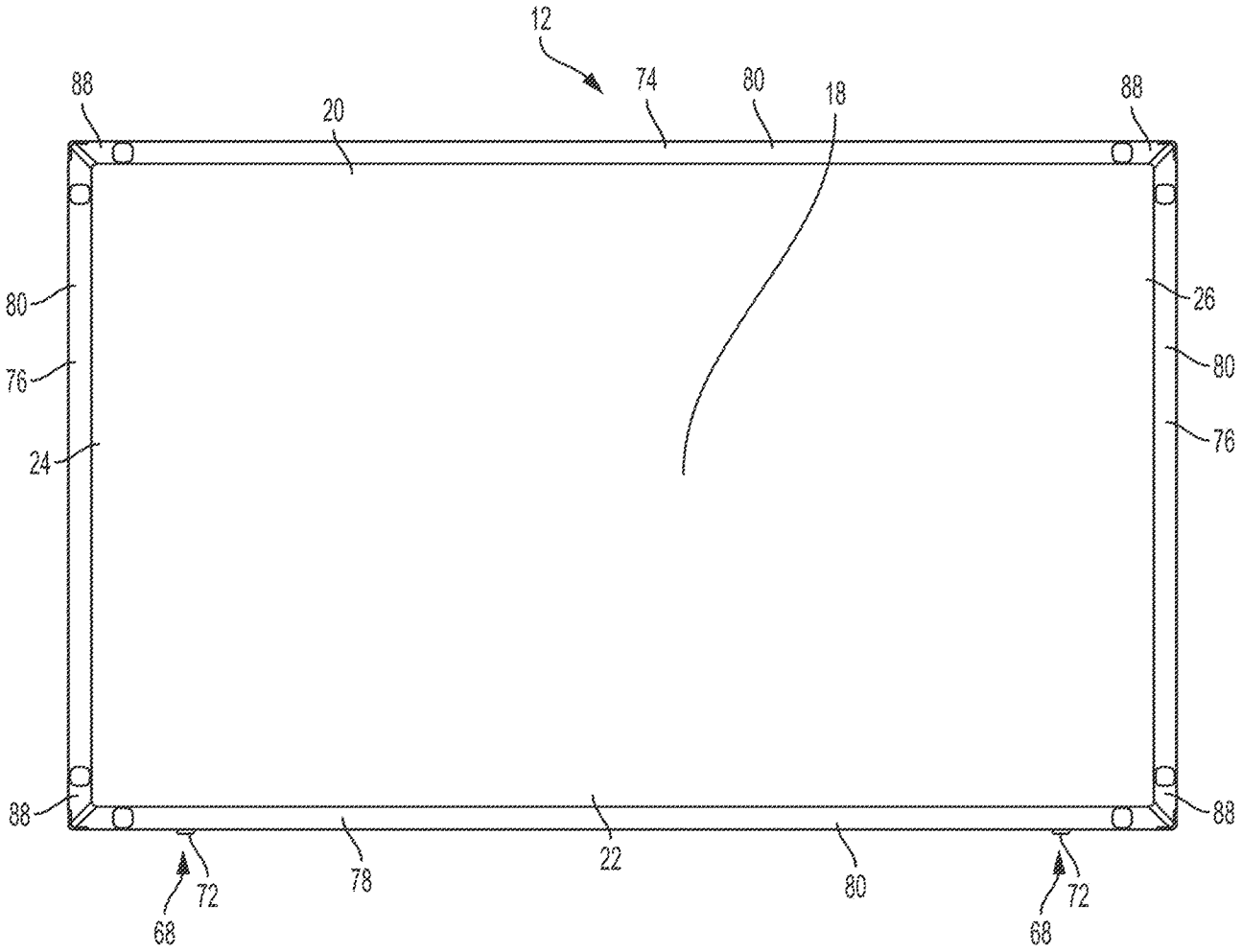
FIG. 2 is a side view of one of the screens of the screen assembly.
Figure 3B:
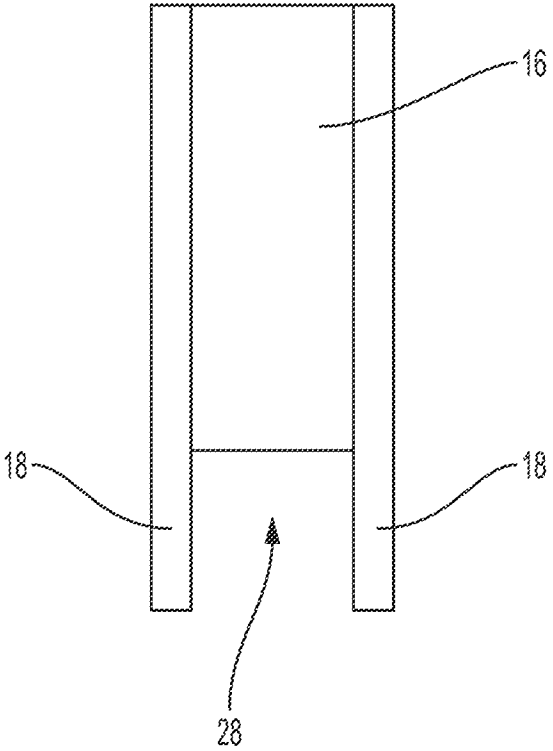
FIG. 3B is an enlarged, end view of a portion of the screen shown in FIG. 2.

As illustrated in FIGS. 2-3B, each screen 12 includes a plurality of panels. In the illustrated embodiment, each screen 12 includes three panels: an inner panel 16 positioned between two outer panels 18. The panels 16, 18 are generally rectangular, planar members. Each panel 16, 18 includes a top edge 20, a bottom edge 22, and two side edges 24, 26. The top edge 20 and the bottom edge 22 are parallel to each other. The two side edges 24, 26 are also parallel to each other and are perpendicular to the top and bottom edges 20, 22. The two outer panels 18 are spaced apart a distance that is equal to the thickness of the inner panel 16.

Figure 3A:
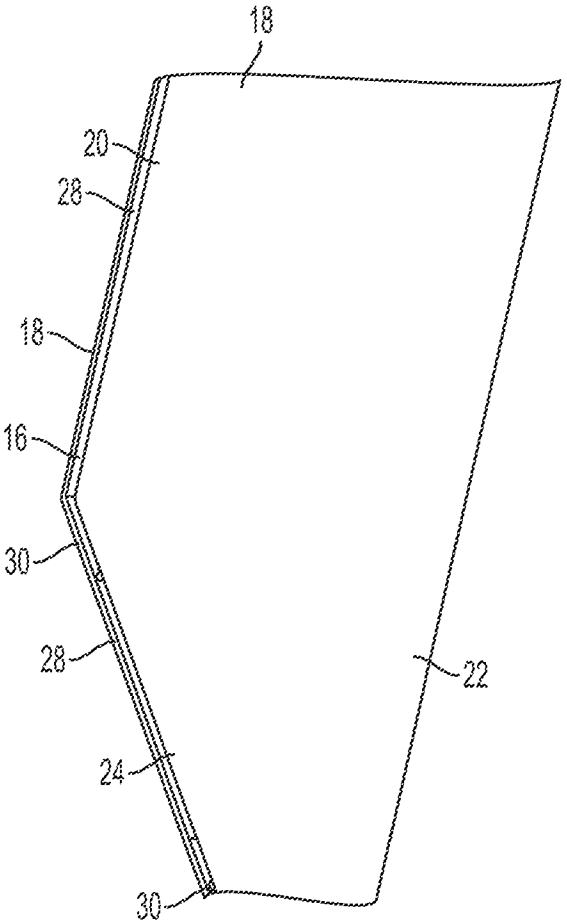
FIG. 3A is a perspective view of a portion of the screen shown in FIG. 2.
Figure 4:
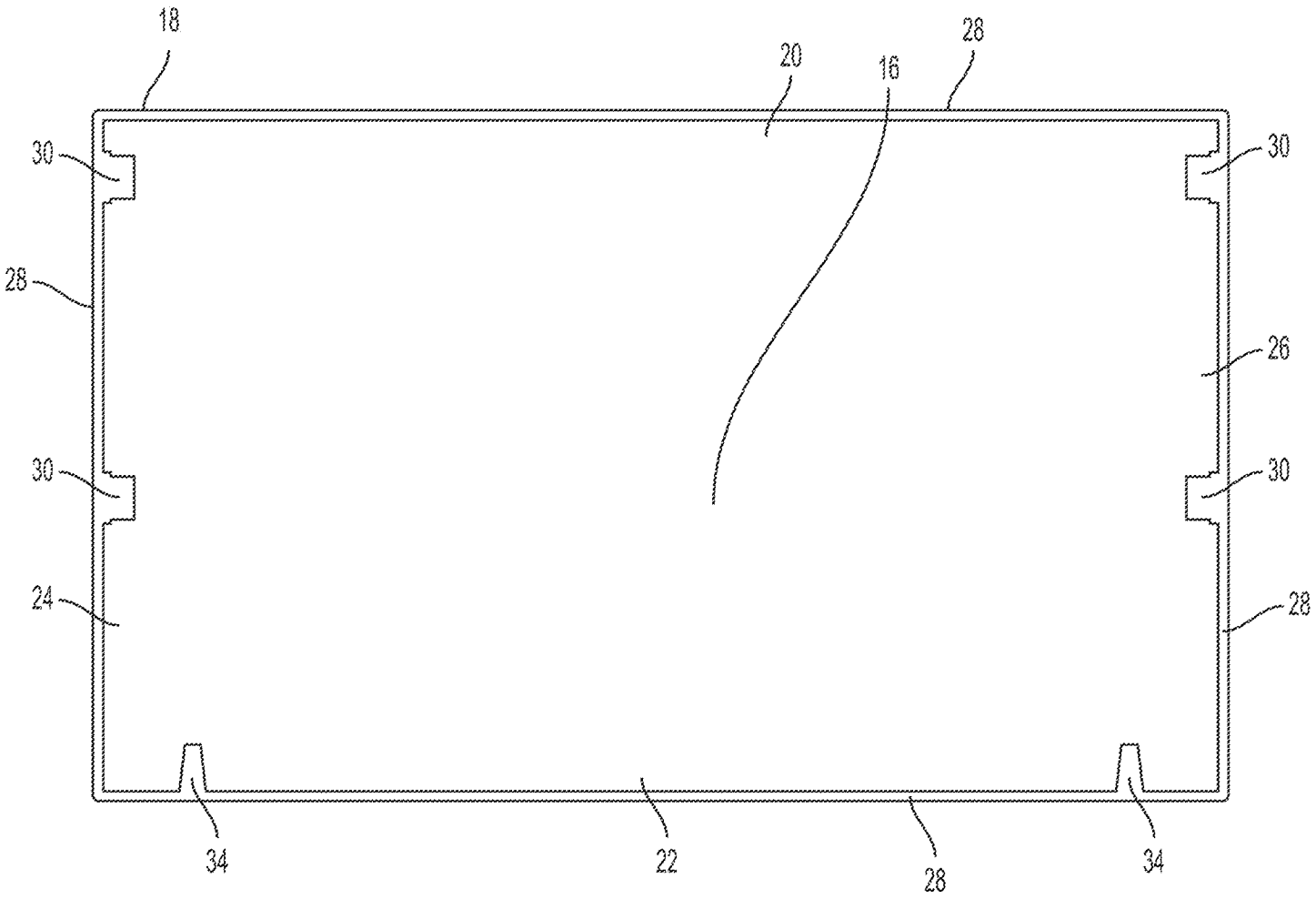
FIG. 4 is a side view of an inner panel of the screen shown in FIG. 2.

The inner panel 16 may be coupled to the two outer panels 18 by any suitable means. For example, the outer panels 18 may be coupled to the inner panel 16 by an adhesive, a plurality of threaded fasteners, a plurality of nails, and the like. As illustrated in FIGS. 3A-4, the inner panel 16 is generally smaller than the outer panels 18 such that when the outer panels 18 are coupled to the inner panel 16, a channel 28 is formed between the outer panels 18 along a perimeter of the inner panel 16. In the illustrated embodiment, the channel 28 has a height or depth (e.g., from an outer edge of the inner panel 16 to an outer edge of the outer panel 18) of approximately 0.5 inches. In other embodiments, the depth of the channel 28 may be relatively larger or smaller than 0.5 inches.

In the illustrated embodiment, the inner panel 16 is approximately 0.5 inches thick and is constructed from fiberglass. The outer panels 18 are approximately 0.125 inches thick and are also constructed from fiberglass. The heights and widths of the inner and outer panels 16, 18 may vary, but a similar size difference is maintained between them to form the channel 28. The outer panels 18 are constructed from fiberglass that is denser than the fiberglass used for the inner panel 16. In particular, the inner panel 16 may be constructed from a fiberglass with a density of about 10 $lb/ft^3$, whereas the outer panels 18 may be constructed from a fiberglass with a density of about 14 $lb/ft^3$.

Figure 5:
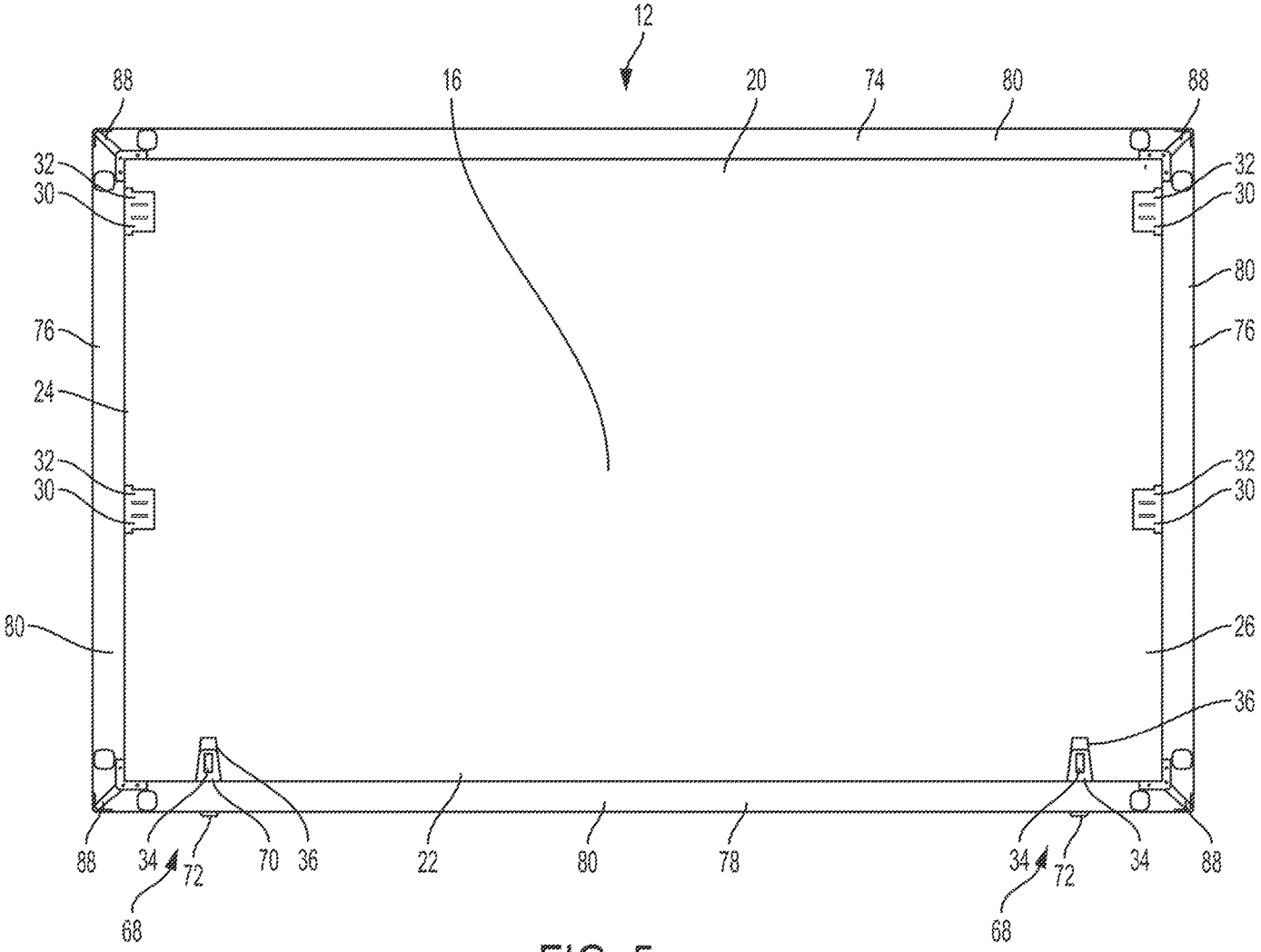
FIG. 5 is a side view of the screen shown in FIG. 2 with an outer panel omitted.

FIGS. 4 and 5 illustrate the inner panel 16 in more detail. The illustrated inner panel 16 includes multiple recesses 30, 34, or compartments, adjacent the edge of the inner panel 16. In particular, two recesses 30 are formed adjacent each side edge 24, 26 of the inner panel 16, and two recesses 34 are formed adjacent the bottom edge 22 of the inner panel 16. Each side recess 30 is configured (i.e., shaped and size) to receive a receiver 32 (FIGS. 5 and 6), as further described below. In the illustrated embodiment, one of the side recesses 30 is positioned near the center of the corresponding side edge 24, 26, and the other side recess 30 is positioned toward the top edge 20 of the inner panel 16. Each bottom recess 34 is configured (e.g., shaped and sized) to receive a stand assembly 35 (FIGS. 5 and 9), as further described below. The bottom recesses 34 are positioned near opposite side edges 24, 26 of the inner panel 16. In other embodiments, the inner panel 16 may include fewer or more recesses 30, 34, and/or the recesses 30, 34 may be positioned elsewhere on the panel 16.

Figure 8:
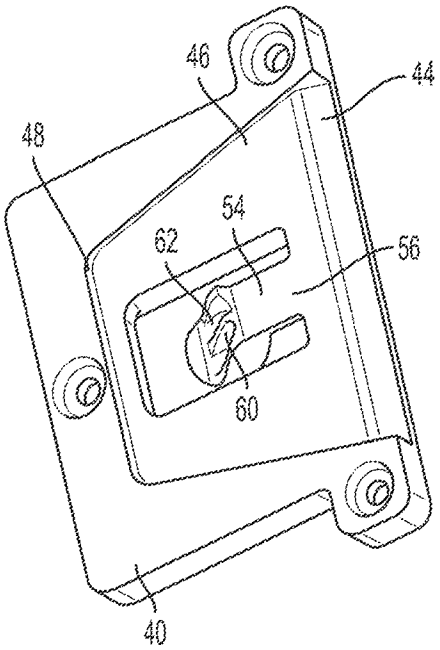
FIG. 8 is a perspective view of another half of the receiver shown in FIG. 6.
Figure 7:
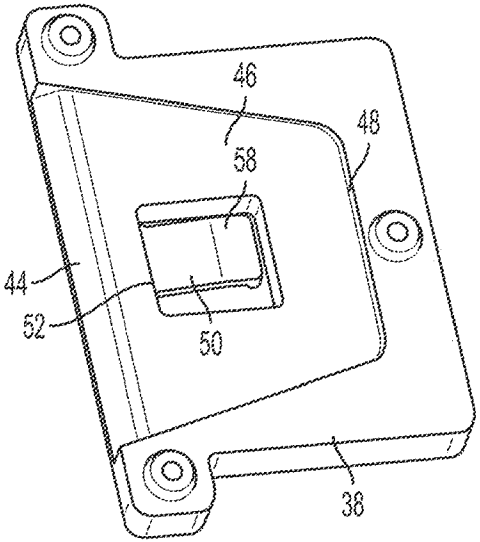
FIG. 7 is a perspective view of one half of the receiver shown in FIG. 6.
Figure 6:
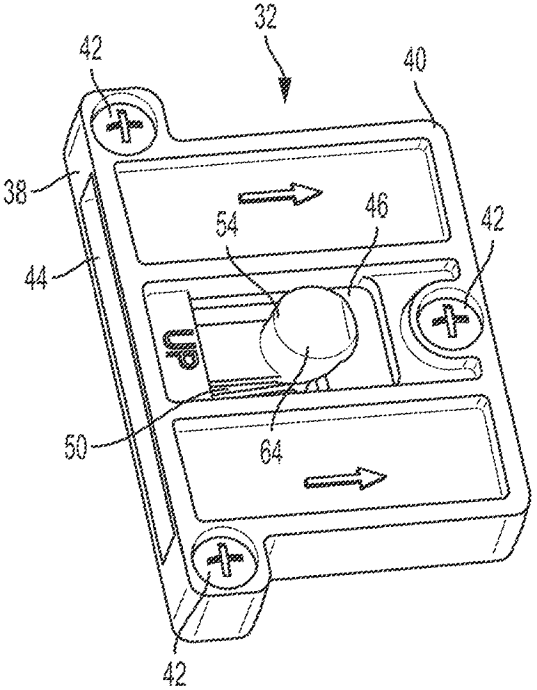
FIG. 6 is a perspective view of a receiver for use with the screen shown in FIG. 2.

As shown in FIGS. 6-8, the illustrated receiver 32 includes a body 37 having two halves 38, 40. In the illustrated embodiment, the halves 38, 40 are coupled together by threaded fasteners 42 (e.g., screws). When assembled, the body 37 has a slot 44 formed between the two halves 38, 40. The slot 44 is formed along an edge of the body 37 and leads to a cavity 46 within the body 37. The illustrated cavity 46 is generally trapezoidal-shaped with a closed end 48. The closed end 48 has a length that is smaller than the length of the slot 44. The cavity 46 is configured (i.e., shaped and sized) to mate with the connector 14, as explained in greater detail below. When positioned within a corresponding recess, an outer edge of the receiver 32 that faces the connector 14 and defines the slot 44 is positioned flush with or inwardly of a perimeter of the inner panel 16.

FIG. 7 illustrates the first half 38 of the receiver 32. The first half 38 includes a locking member 50. The illustrated locking member 50 is a cantilevered arm or finger that extends toward the second half 40 of the receiver 32. The locking member 50 projects across the cavity 46 of the receiver 32 and is capable of moving (e.g., flexing or pivoting) about a pivot axis 52 on the first half 38. The locking member 50 is constructed to be biased into a position where the locking member 50 extends into the cavity 46 toward the second half 40 of the receiver 32, as shown in FIG. 7.

FIG. 8 illustrates the second half 40 of the receiver 32. The second half 40 includes an actuator 54. The illustrated actuator 54 includes a cantilevered push button that can be engaged and depressed by a user. Similar to the locking member 50, the actuator 54 is capable of moving (e.g., flexing or pivoting) about a pivot axis 56 on the second half 40. The actuator 54 is constructed to be biased away from the locking member 50.

Referring to FIGS. 7 and 8, the locking member 50 includes a flat portion 58 formed at a distal end of the locking member 50 that contacts an inner portion 60 of the actuator 54. The inner portion 60 of the actuator 54 includes an angled face 62 to aid in disengaging the locking member 50 from a connector 94 (FIGS. 15-18) and disassembling the screen assembly 10, as further described below. In particular, a user is able to actuate (e.g., press down on) a contact point 64 of the actuator 54 and urge the locking member 50 away from the second half 40 and out of the cavity 46.

Figure 10:
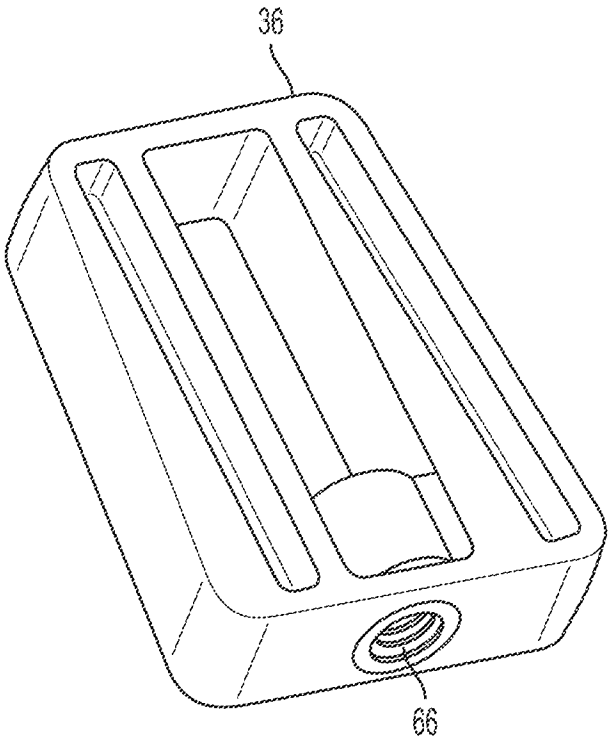
FIG. 10 is a perspective view of the mount shown in FIG. 9.
Figure 9:
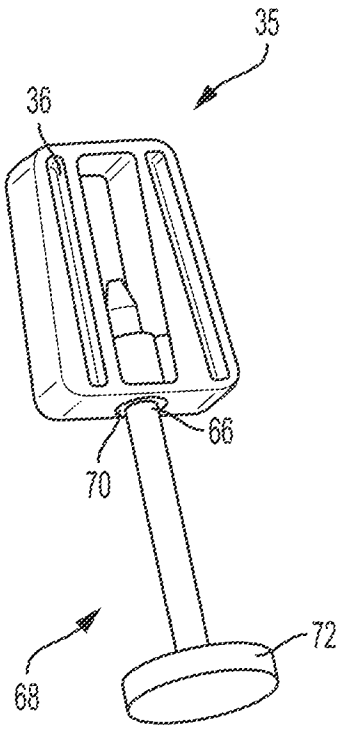
FIG. 9 is a perspective view of a stand assembly for use with the screen shown in FIG. 2, the stand assembly including a mount and a stand.

FIG. 9 illustrates the stand assembly 35. The illustrated stand assembly 35 includes a mount 36 and a stand 68. The mount 36 is shaped and sized to be received in one of the bottom recesses 34 of the inner panel 16. When positioned within a corresponding recess, an outer edge of the mount 36 that faces the stand 68 is positioned flush with or inwardly of the perimeter of the inner panel 16. In the illustrated embodiment, the mount 36 includes a threaded passage or opening 66 (FIG. 10) that receives a threaded stem 70 of the stand 68. The stand 68 also includes platform or foot 72 coupled to an end of the threaded stem 70 opposite from the mount 36. The platform 72 is configured to be used as a base for holding the screen 12 upright on the ground or other surface. The threaded interface between the opening 66 and the stem 70 allows a user to vary how far the stand 68 projects from the mount 36 so that the user can vary a height of the screen 12 and/or level the screen 12.

Figure 11:
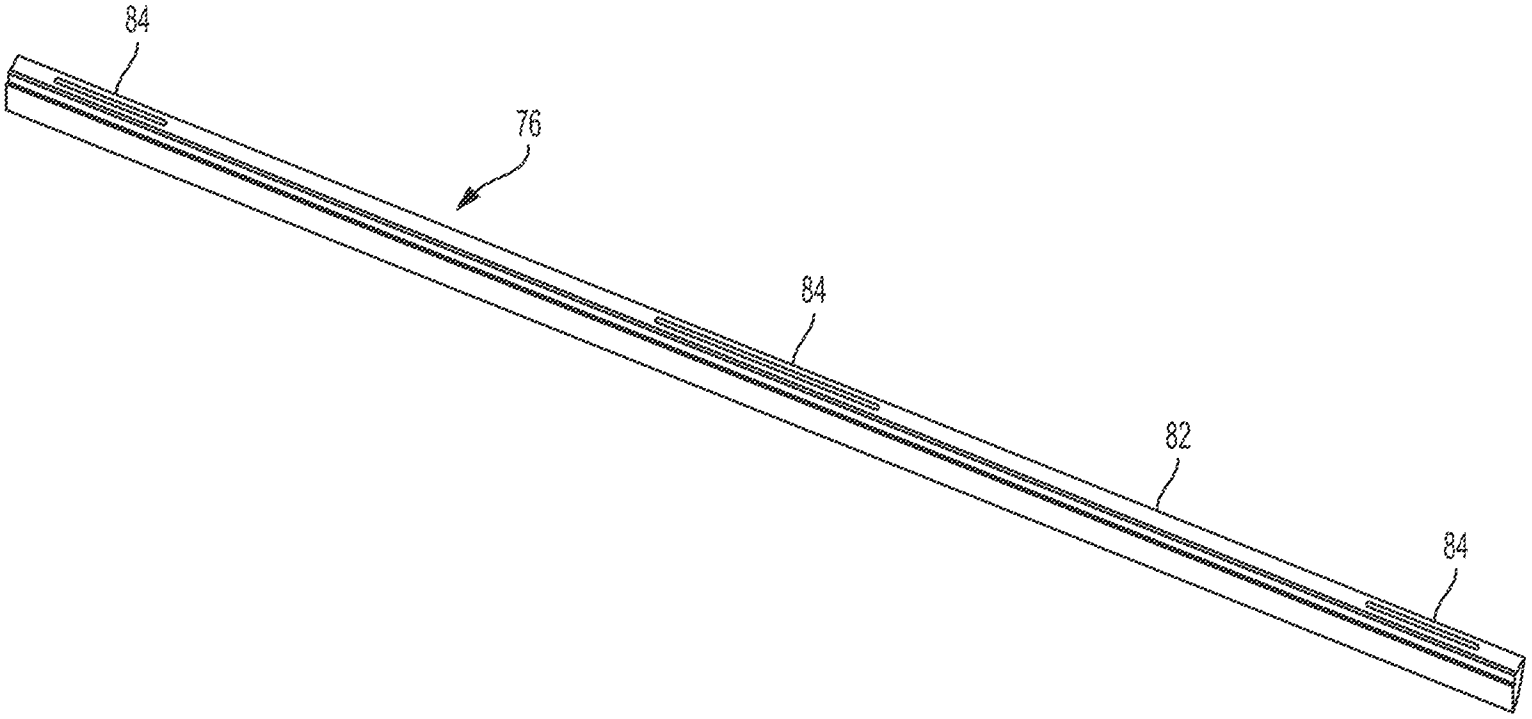
FIG. 11 is a perspective view of a side frame member of the screen shown in FIG. 2.
Figure 12:
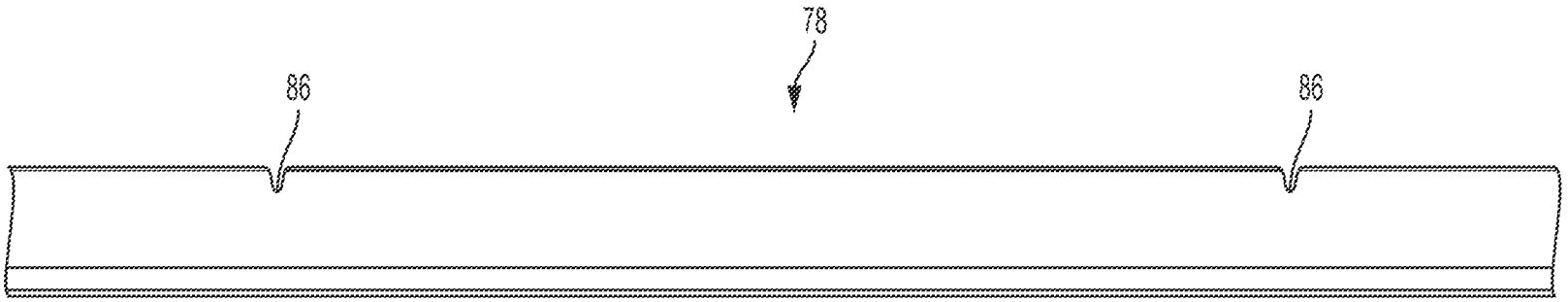
FIG. 12 is a plan view of a bottom frame member of the screen shown in FIG. 2.

Referring back to FIG. 5, the screen 12 includes frame members 74, 76, 78 positioned around the perimeter of the panels 16, 18. In particular, the screen 12 includes a top frame member 74 extending along a top edge 20 of the panels 16, 18, side frame members 76 extending along the side edges 24, 26 of the panels 16, 18, and a bottom frame member 78 extending along the bottom edge 22 of the panels 16, 18. As shown in FIG. 11, each side frame member 76 includes two openings 84 that generally align with the side recesses 30 in the inner panel 16. The openings 84 extend through the entire width of the side frame member 76. As shown in FIG. 12, the bottom frame member 78 also includes two openings 86. The openings 86 in the bottom frame member 78 generally align with the bottom recesses 34 of the inner panel 16 and extend through the entire width of the bottom frame member 78.

Figure 13:
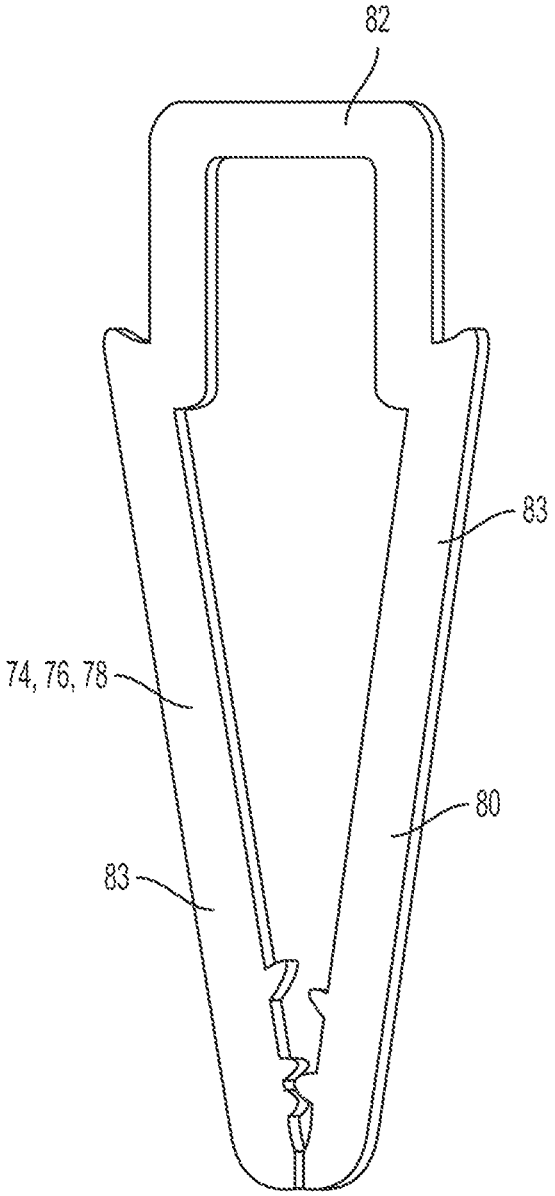
FIG. 13 is a cross-sectional view of a frame member for use with the screen shown in FIG. 2.

As shown in FIG. 13, each of the frame members 74, 76, 78 has generally the same cross-section. In the illustrated embodiment, the cross-section of each frame member 74, 76, 78 includes an outer portion 80 that is generally triangular-shaped and an inner portion 82 that is generally rectangular-shaped. The outer portion 80 includes two jaws 83 that can move (e.g., flex or bend) relative to each other. The jaws 83 are configured to receive a piece of cloth or fabric therebetween. For example, the jaws 83 can receive and secure edge portions of a fabric sheet that extends over and covers the outer surfaces of the screen 12. The inner portion 82 is shaped to fit securely within the channel 28 (FIGS. 3A and 3B) defined between the outer panels 18 of the screen.

Figure 14:
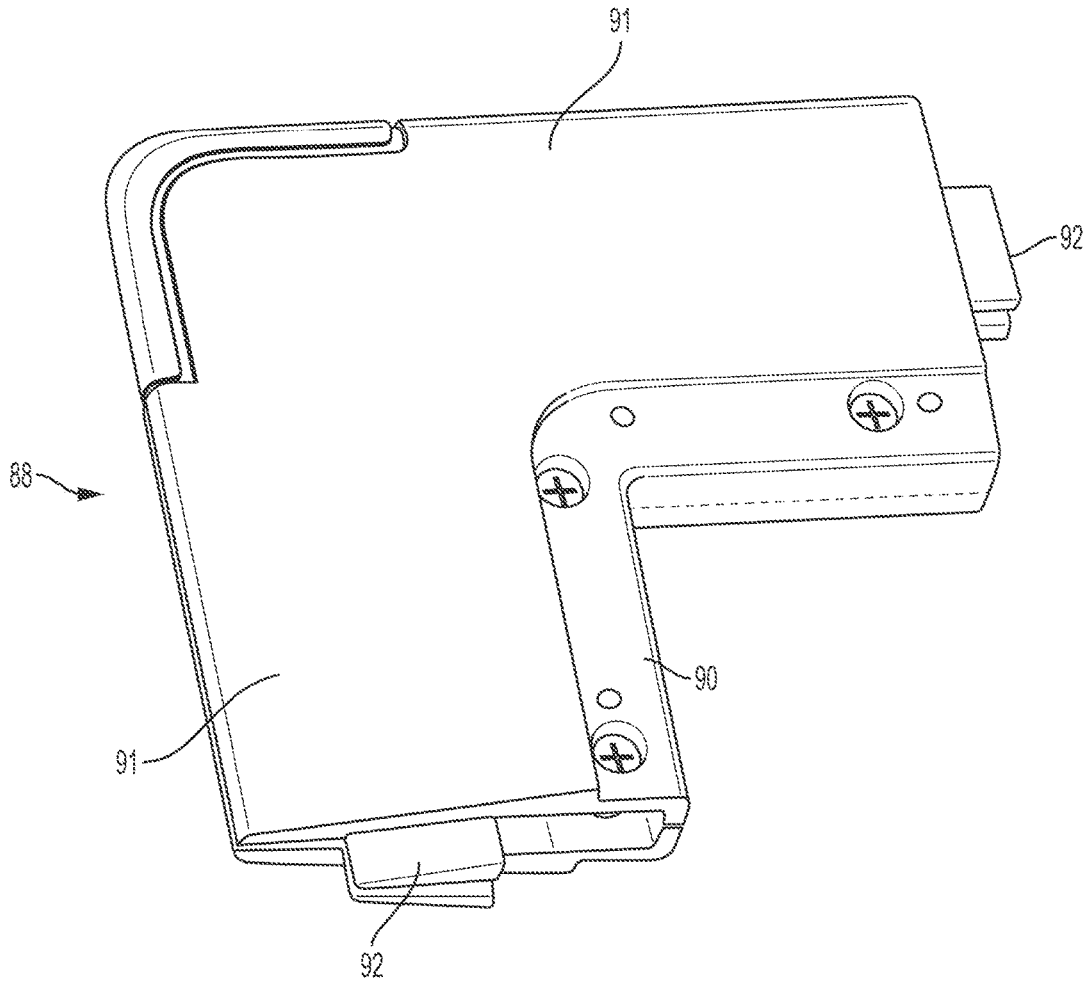
FIG. 14 is a perspective view of a corner frame member of the screen shown in FIG. 2.

FIG. 14 illustrates a corner frame member 88 configured to couple together two frame members (e.g., the upper frame member 74 and one of the side frame members 76, or the bottom frame member 78 and one of the side frame members 76) at adjacent ends. Similar to the other frame members 74, 76, 78, the illustrated corner frame member 88 includes a cross-section with an inner portion 90 that is generally rectangular-shaped to fit securely with the channel 28 (FIGS. 3A and 3B) of the screen 12, and an outer portion 91 that is generally triangular-shaped to receive an edge portion of a fabric sheet. The corner assembly 88 also includes a projection 92 at each end. The illustrated projections 92 are generally triangular-shaped. The projections 92 are configured to fit into the other frame members 74, 76, 78 to connect the frame members 74, 76, 78, 88 together.

Referring back to FIG. 5, the assembled screen 12 includes the inner panel 16, two outer panels 18 (one of which is omitted to facilitate viewing of the inner components of the screen 12), four receivers 32, two stand assemblies 35, the top frame member 74, two side frame members 76, the bottom frame member 78, and four corner frame members 88. The receivers 32 are shaped and sized to fit within the side recesses 30 of the inner panel 16, and the stand assemblies 35 are shaped and sized to fit within the bottom recesses 34 of the inner panel 16. The receivers 32 are positioned within the recesses 30 so that the slots 44 face outward from the screen 12 (e.g., to the left and right in FIG. 5). The stand assemblies 35 are positioned within the recesses 34 so that the stands 68 extend outwardly from the screen 12 (e.g., downward in FIG. 5). In some embodiments, the receivers 32 and the stand assemblies 35 may be frictionally held in the recesses 30, 34 of the panel 16. In other embodiments, the receivers 32 and the stand assemblies 35 may be secured within the recesses 30, 34 by adhesives, fasteners, and/or other suitable securing means.

FIGS. 15-18 illustrate connectors 14 for coupling together two adjacent screens 12. The illustrated connectors 14 are elongate members that extend along and fit between the side edges 24, 26 of the screens 12. In the illustrated embodiment, each connector 14 is a unitary member made of metal (e.g., steel). In other embodiments, each connector 14 may be made of multiple pieces that are secured (e.g., welded, glued, etc.) together or that are simply associated with each other. Additionally or alternatively, the connectors 14 may be made of other suitable materials, such as plastic.

Figure 16:
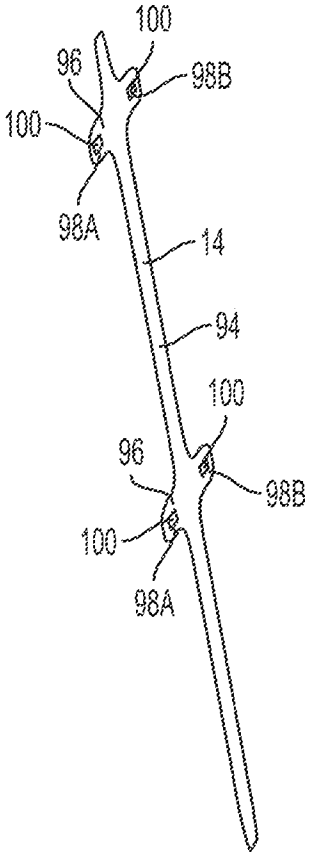
FIG. 16 is a perspective view of the connector of FIG. 15.
Figure 15:
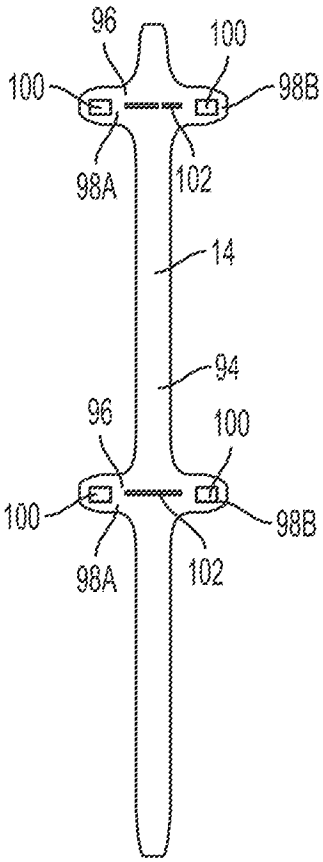
FIG. 15 is a plan view of a connector for use with the screen assembly.
Figure 18:
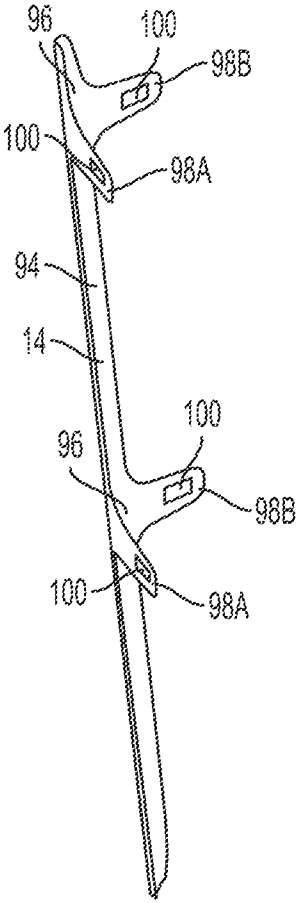
FIG. 18 is a perspective view of the connector of FIG. 17.
Figure 17:
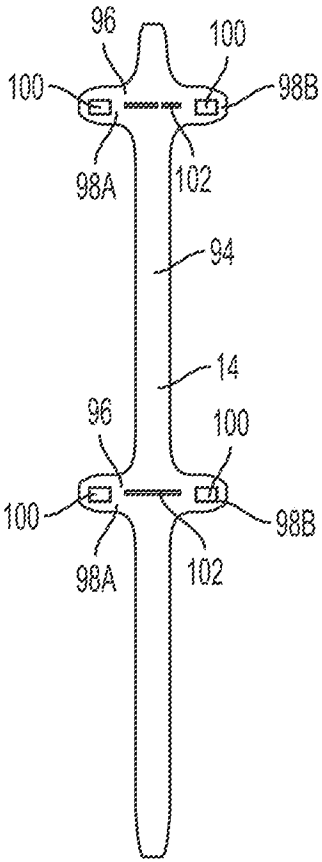
FIG. 17 is a plan view of another connector for use with the screen assembly.

Each connector 14 includes a body 94 and multiple linking points 96. In the illustrated embodiment, each connector 14 includes two linking points 96. Each linking point 96 includes two contacts 98A, 98B that extend outwardly from the body 94. The contacts 98A, 98B of each linking point 96 are generally aligned so that the contacts 98A, 98B extend outwardly from the body 94 at the same height. The first contact 98A extends in a first direction from the body 94. The second contact 98B extends in a second direction from the body 94 that is different than the first direction. As shown in FIGS. 15 and 16, the first and second contacts 98A, 98B extend in substantially opposite directions from the body 94. In other words, an angle between the two contacts 98A, 98B is 180 degrees. As shown in FIGS. 17 and 18, the first and second contacts 98A, 98B extend in non-parallel directions. For example, the illustrated contacts 98A, 98B extend in different directions that are angled approximately 90 degrees relative to each other. In other embodiments, the angle between the contacts 98A, 98B may be about 120 degrees, or any other desired angle between 20 degrees and 340 degrees.

The contacts 98A, 98B are configured to fit within the cavities 46 of the receivers 32 on the screen 12 (FIG. 5). Each of the illustrated contacts 98 is a generally trapezoidal, plate-shaped member and includes a central opening 100. The opening 100 is configured to allow the locking member 50 (FIG. 7) of one of the receivers 32 to extend through the opening 100. When the contact 98A, 98B is inserted into the receiver 32 and the locking member 50 extends into the opening 100, the connector 14 is secured to the screen 12. The two contacts 98A, 98B on the same side of the body 94 (e.g., either the contacts 98A or the contacts 98B) are spaced apart to fit within the two receivers 32 on one side edge 24, 26 of the screen 12. The other contacts 98A, 98B on the other side of the body 94 can then be inserted into and secured to the receivers 32 in an adjacent panel. In some embodiments, each linking point 96 may include three or more contacts for coupling together more than two adjacent screens 12.

In the illustrated embodiment, each linking point 96 also includes a mark 102 to help identify the location of the actuator 54 (FIG. 6) on the corresponding receiver 32. In the illustrated embodiment, the mark 102 is an elongated rib extending between the corresponding contacts 98A, 98B. In other embodiments, the mark 102 may be a slot, bump or series of bumps, unique color or discoloration, or the like. The illustrated mark 102 is aligned with the centers of the openings 100 of the contacts 98A, 98B to thereby identify the contact points 64 on the actuators 54. When the connector 14 is positioned between two adjacent screens 12, at least a portion of the mark 102 remains visible to a user through a gap between the screens 12.

Figure 19:
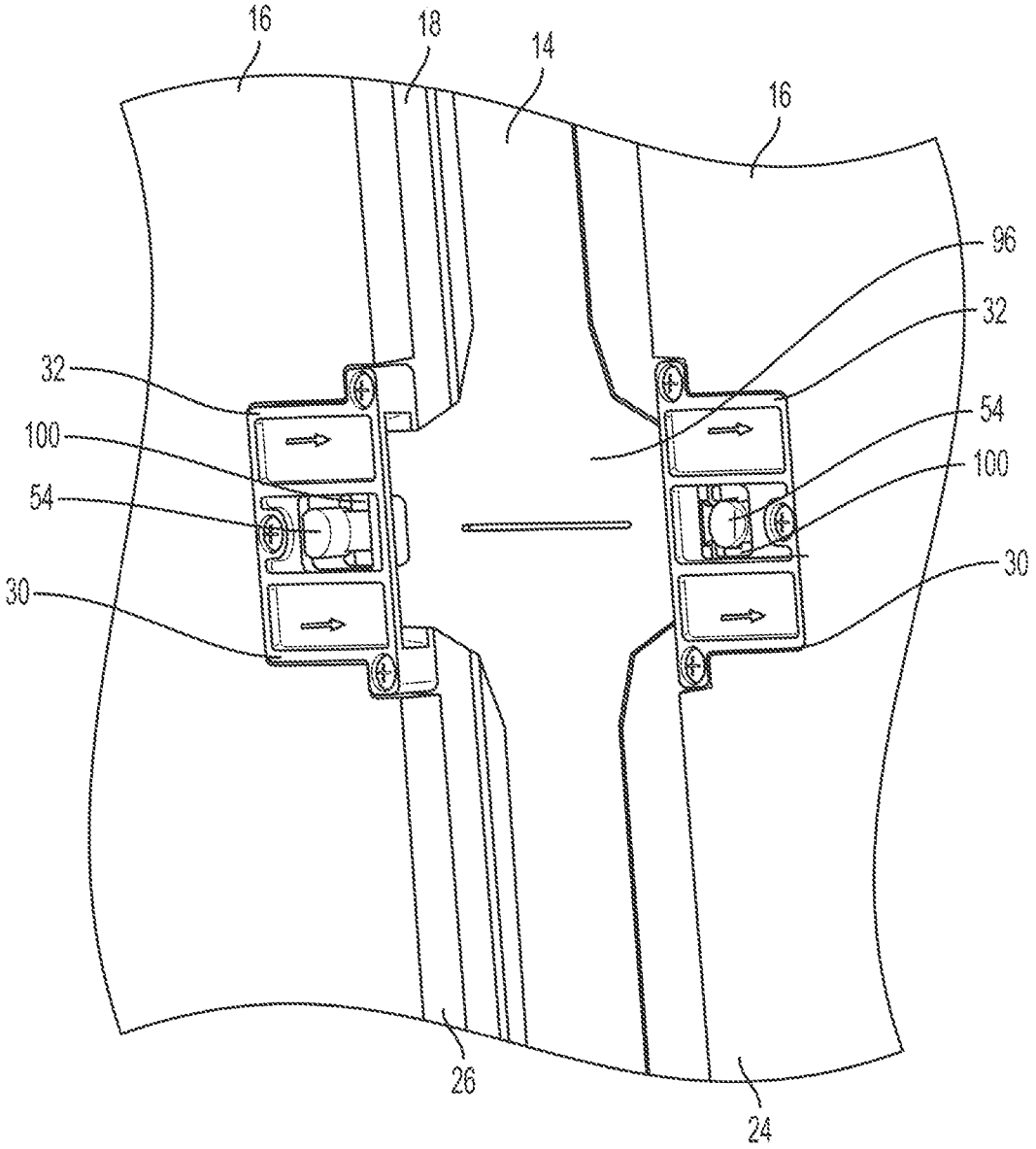
FIG. 19 is a perspective view of a portion of the screen assembly, illustrating two screens coupled together by the connector of FIG. 15.

FIGS. 1 and 19 illustrate adjacent screens 12 coupled together by connectors 14. To assemble the connector 14 with two adjacent screens 12, the connector 14 is aligned with one of the side frame members 24, 26 of one of the screens 12 so that the contacts 98A are aligned with the receivers 32. The contacts 98A are then inserted through the openings 84 in the side frame member 24, 26 and through the slot 44 of the respective receivers 32. As the contacts 98A are inserted through the slots 44, the leading edges of the contacts 98A engage the locking members 50 of the receivers 32. The contacts 98A are then continued to be pushed into the cavities 46 of the receivers 32 with sufficient force to move the locking members 50 about the pivot axes 52 so that the locking members 50 deflect out of the way of the contacts 98A. When the leading edges of the contacts 98A clear the locking members 50, and the openings 100 in the contacts 98A align with the locking members 50, the locking members 50 automatically bias back. Accordingly, the locking members 50 project across the cavities 46, through the openings 100 of the contacts 98A, and engage the actuators 54 to secure connector 14 to the screen 12 with a snap-fit or "click."

This same process is then repeated to connect the connector 14 (and more specifically the contacts 98B of the connector 14) to the second, adjacent screen 12. Once the connector 14 is coupled to the both screens 12, the screens 12 are secured together, as shown in FIG. 1.

To disassemble the connector 14 from the screens 12, a user first locates the actuators 54 of the receivers 32 on one of the screens 12. In some scenarios, the actuators 54 may be hidden behind one of the outer panels 18 or behind a fabric layer extending over the outer surface of the screen 12. The user then concurrently beings separating the screen 12 from the connector 14 and actuating (e.g., depressing) the actuators 54. Actuating the actuator 54 pushes the locking member 50 out of the opening of the contact 98A, 98B so that the angled face 62 of the actuator 54 is aligned with the contact 98A, 98B. Continued separation of the screen 12 from the connector 14 causes the contact 98A, 98B to abut the angled face 62, which moves a solid portion of the contact 98A, 98B between the actuator 54 and the locking member 50 to inhibit the locking member 50 from reentering the opening 100. The user then releases the actuator 54 and continues to move the screen 12 away from the connector 14 so that the contact 98A, 98B exits the corresponding receiver 32.

If desired, this same process can then be repeated to completely remove the connector 14 from the other screen 12. Alternatively, the connector 14 may be left secured to one of the screens 12 so that the screen 12 can be more quickly attached to another screen later.

Figure 20:
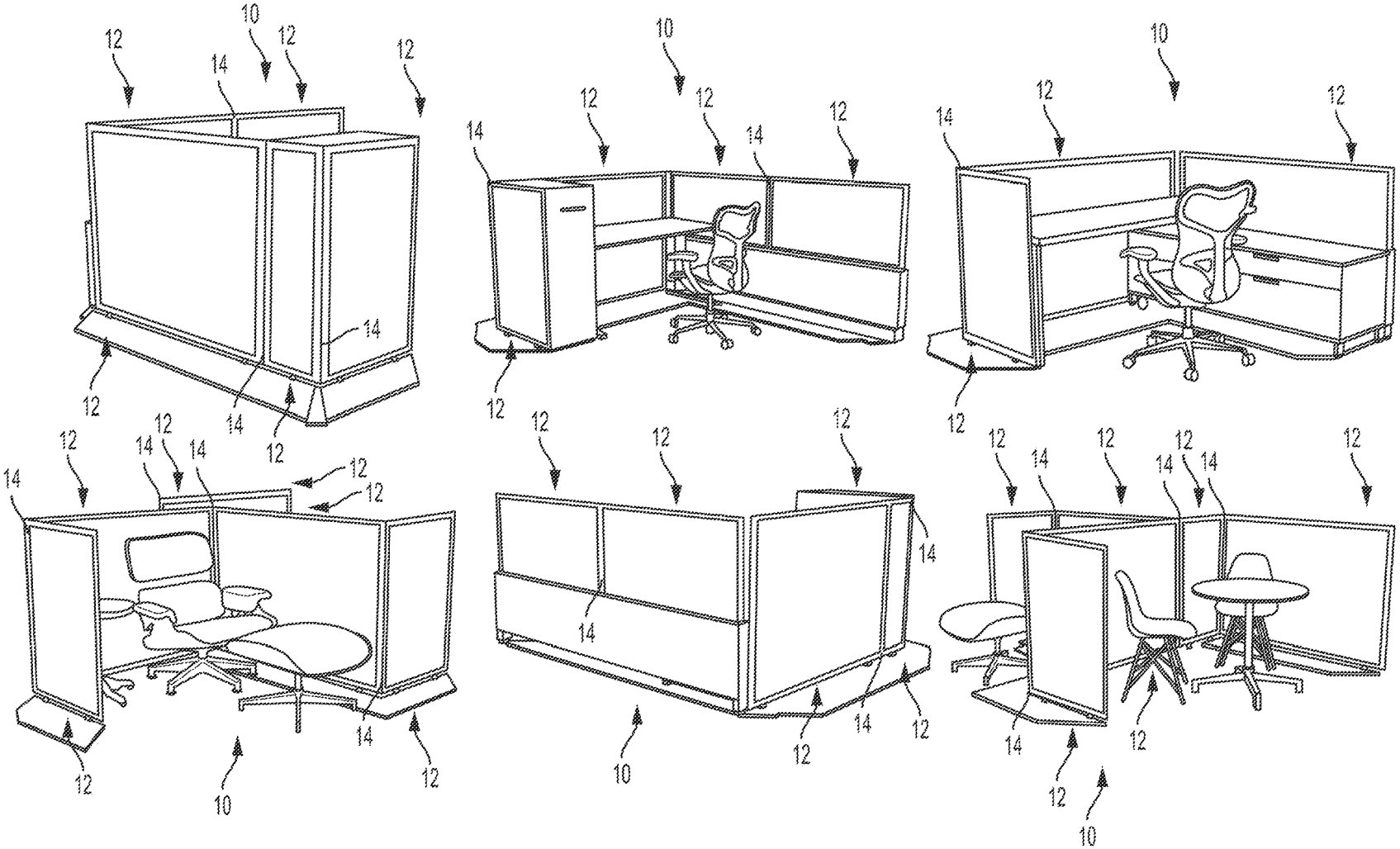
FIG. 20 illustrates perspective views of various workspaces formed using the screen assembly.

FIG. 20 illustrates various, exemplary screen configurations that can be achieved using the screens 12 and the connectors 14 described above. As shown in these figures, the screens 12 can be arranged to create small enclosures. Desks, drawers, and other furniture items may be used in conjunction with the enclosures to create a suitable workspace. The screens 12 provide at least some privacy between the workspaces, and may also be used as a tackboard or mounting surface to hang other objects.

Various features and advantages of the disclosure are set forth in the following claims.

What is claimed is:

1. A screen assembly comprising:

a first screen including a first panel having a first recess and a first receiver positioned within the first recess, the first receiver having a first locking member and a first actuator, the first actuator operable to move the first locking member relative to the first receiver;

a second screen including a second panel having a second recess and a second receiver positioned within the second recess, the second receiver having a second locking member and a second actuator, the second actuator operable to move the second locking member relative to the second receiver; and a connector including a body, a first contact extending from the body in a first direction, and a second contact extending from the body in a second direction, the first contact being received in the first receiver and having a first opening through which the first locking member extends, the second contact being received in the second receiver and having a second opening through which the second locking member extends, wherein each locking member includes a cantilevered finger having a distal end that extends into the corresponding opening of the corresponding contact, wherein the distal end of each cantilevered finger includes a flat portion, wherein the flat portion of each cantilevered finger engages an angled face of the corresponding actuator, wherein each actuator includes a contact point on an opposite side of the actuator from the angled face, and wherein each contact point is actuatable by a user to move the distal end of the corresponding cantilevered finger out of the corresponding opening.

2. The screen assembly of claim 1, wherein the first and second actuators are biased away from the first and second locking members, respectively, and wherein each actuator is movable toward the corresponding locking member to move the locking member out of the corresponding opening.

3. The screen assembly of claim 1, wherein the first contact and the second contact are generally aligned on opposite sides of the body.

4. The screen assembly of claim 3, wherein the first contact and the second contact extend in substantially opposite directions from the body.

5. The screen assembly of claim 3, wherein the first direction and the second direction are angled between about 90 degrees and about 120 degrees relative to each other.

6. The screen assembly of claim 1, wherein the connector includes a mark extending between the first contact and the second contact to identify locations of the first actuator and the second actuator.

7. The screen assembly of claim 1, wherein the first screen further includes a third recess and a third receiver positioned within the third recess, the third receiver having a third locking member and a third actuator, the third actuator operable to move the third locking member relative to the third receiver;

wherein the second screen further includes a fourth recess and a fourth receiver positioned within the fourth recess, the fourth receiver having a fourth locking member and a fourth actuator, the fourth actuator operable to move the fourth locking member relative to the fourth receiver;

wherein the body of the connector is an elongated body, and wherein the connector further includes a third contact and a fourth contact, the third contact being spaced apart from the first contact and extending from the elongated body in the first direction, the third contact being received in the third receiver and having a third opening through which the third locking member extends, the fourth contact being spaced apart from the second contact and extending from the elongated body in the second direction, the fourth contact being received in the fourth receiver and having a fourth opening through which the fourth locking member extends.

8. The screen assembly of claim 1, wherein the first panel and the second panel are inner panels, wherein the first screen further includes two outer panels positioned on opposing sides of the first panel, and wherein the second screen further includes two outer panels positioned on opposing sides of the second panel.

9. The screen assembly of claim 8, wherein the first recess is formed in the first panel between the two outer panels, and wherein the second recess is formed in the second panel between the two outer panels.

10. The screen assembly of claim 1, wherein each receiver has an outer edge facing the connector, wherein the outer edge of the first receiver is positioned flush with or inwardly of a perimeter of the first panel, and wherein the outer edge of the second receiver is positioned flush with or inwardly of a perimeter of the second panel.

11. A screen assembly comprising:

a first screen including a first panel and a first receiver, the first panel having a first recess positioned along a first edge of the first panel and a second recess positioned along a second edge of the first panel that is perpendicular to the first edge, the first receiver positioned within the first recess, the first receiver having a first locking member and a first actuator, the first actuator operable to move the first locking member relative to the first receiver;

a second screen including a second panel and a second receiver, the second panel having a third recess positioned along a third edge of the second panel and a fourth recess positioned along a fourth edge of the second panel that is perpendicular to the third edge, the second receiver positioned within the third recess, the second receiver having a second locking member and a second actuator, the second actuator operable to move the second locking member relative to the second receiver;

a connector including a body, a first contact extending from the body in a first direction, and a second contact extending from the body in a second direction, the first contact being received in the first receiver and having a first opening through which the first locking member extends, the second contact being received in the second receiver and having a second opening through which the second locking member extends;

a first stand assembly including a first mount and a first stand, the first mount being received in the second recess of the first panel and having a first aperture, the first stand having a first stem and a first foot, the first stem being received in the first aperture, the first foot being coupled to an end of the first stem opposite the first mount; and a second stand assembly including a second mount and a second stand, the second mount being received in the fourth recess of the second panel and having a second aperture, the second stand having a second stem and a second foot, the second stem being received in the second aperture, the second foot being coupled to an end of the second stem opposite the second mount, wherein the first screen further includes a third receiver positioned within the third recess, the third receiver having a third locking member and a third actuator, the third actuator operable to move the third locking member relative to the third receiver;

wherein the second screen further includes a fourth receiver positioned within the fourth recess, the fourth receiver having a fourth locking member and a fourth actuator, the fourth actuator operable to move the fourth locking member relative to the fourth receiver;

wherein the body of the connector is an elongated body, and wherein the connector further includes a third contact and a fourth contact, the third contact being spaced apart from the first contact and extending from the elongated body in the first direction, the third contact being received in the third receiver and having a third opening through which the third locking member extends, the fourth contact being spaced apart from the second contact and extending from the elongated body in the second direction, the fourth contact being received in the fourth receiver and having a fourth opening through which the fourth locking member extends.

12. A screen assembly comprising:

a first screen including a first panel having a first recess and a first receiver positioned within the first recess, the first receiver having a first locking member and a first actuator, the first actuator operable to move the first locking member relative to the first receiver;

a second screen including a second panel having a second recess and a second receiver positioned within the second recess, the second receiver having a second locking member and a second actuator, the second actuator operable to move the second locking member relative to the second receiver; and a connector including a body, a first contact extending from the body in a first direction, and a second contact extending from the body in a second direction, the first contact being received in the first receiver and having a first opening through which the first locking member extends, the second contact being received in the second receiver and having a second opening through which the second locking member extends, wherein the first screen further includes a third recess and a third receiver positioned within the third recess, the third receiver having a third locking member and a third actuator, the third actuator operable to move the third locking member relative to the third receiver;

wherein the second screen further includes a fourth recess and a fourth receiver positioned within the fourth recess, the fourth receiver having a fourth locking member and a fourth actuator, the fourth actuator operable to move the fourth locking member relative to the fourth receiver;

wherein the body of the connector is an elongated body, and wherein the connector further includes a third contact and a fourth contact, the third contact being spaced apart from the first contact and extending from the elongated body in the first direction, the third contact being received in the third receiver and having a third opening through which the third locking member extends, the fourth contact being spaced apart from the second contact and extending from the elongated body in the second direction, the fourth contact being received in the fourth receiver and having a fourth opening through which the fourth locking member extends.

* * * * *